United States Patent [19]

Nishiguchi

[11] Patent Number: 4,848,411

[45] Date of Patent: Jul. 18, 1989

[54] WARP STOP MOTION MECHANISM FOR LOOMS

[75] Inventor: Narachiyo Nishiguchi, Osaka, Japan

[73] Assignees: Nishiki Sangyo Kabushiki Kaisha; Tokuji Koshiba, both of Osaka, Japan

[21] Appl. No.: 113,776

[22] Filed: Oct. 16, 1987

[30] Foreign Application Priority Data

Apr. 13, 1987 [JP] Japan ..... 62-91510

[51] Int. Cl.[4] ..... C03D 51/28

[52] U.S. Cl. ..... 139/358; 139/369; 28/187

[58] Field of Search ..... 139/359, 369

[56] References Cited

U.S. PATENT DOCUMENTS 2,844,860 6/1958 Ayers et al. ..... 139/353
4,367,771 1/1983 Baumann ..... 139/358
4,385,647 5/1983 Nishiguchi ..... 139/369

FOREIGN PATENT DOCUMENTS 3029505 3/1981 Fed. Rep. of Germany ..... 139/353
223342 12/1984 Japan ..... 139/353

*Primary Examiner*—Henry S. Jaudon
*Attorney, Agent, or Firm*—Armstrong, Nikaido Marmelstein Kubovcik & Murray

[57] ABSTRACT

A warp stop motion mechanism for a loom includes droppers adapted to fall under their own weight upon warp yarn breakage, and contact bars for receiving the droppers. The contact bars are held between a pair of upper and lower contact bar supports slidably installed on side frames and a warp yarn breakage detecting circuit is disposed between the upper and lower contact bar supports and adapted to be closed by the natural fall of the droppers.

1 Claim, 4 Drawing Sheets

WARP STOP MOTION MECHANISM FOR LOOMS

BACKGROUND OF THE INVENTION

1. Field of the Invention

The present invention relates to a warp stop motion mechanism for looms, and more particularly it relates to a warp stop motion mechanism for looms wherein the insulation support function of the contact bar is improved.

2. Description of the Prior Art

As described in Japanese Patent Application Laid-Open No. 57-176243, a loom is provided with a device for stopping the loom upon warp yarn breakage. To keep pace with the automation and speedup of looms, there has been a demand, as an important subject of rationalization of production, for early detection of warp yarn breakage and quick reliable stoppage of the loom. To meet this demand, I proposed, for example in Japanese Utility Model Publication No. 60-38699, a dropper support fixing device for looms.

FIG. 5 is a top perspective view of a conventional warp stop motion mechanism for looms which comprises contact bars 2 for receiving droppers (not shown) when the latter fall under their own weight upon warp yarn breakage, a contact bar support 3 for sliding the proximal ends of the contact bars arranged at right angles to the direction of travel of warp yarns, a side frame of the loom (not shown) for fixedly supporting the contact bar support 3, and a grip 4 attached to the ends of the contact bars for electrical connection. In the conventional device, the contact bar support 3 is fixed to the side frame by suitable fixing members such as bolts (not shown) and constitutes a warp stop motion mechanism.

Here, there are generally two contact bar supports 3 and a single grip 4. The contact bar supports 3 are fixed to the side frames and provide mechanical support to the contact bars 2, but the contact bars 2 are merely inserted in the grooves or slots (not shown) formed in the contact bar supports 3 for sliding movement therethrough. The contact bars 2 support the grip 4. The bar supports 3 are fixed to the side frames and the contact bars 2 are slidably received within the slots formed in the bar supports 3. The grip 4 which holds the contact bars 2 at one end thereof is connected to the handle 5 by way of the linkage as illustrated in FIG. 5. When the handle 5 is moved in the direction shown in the arrow in FIG. 5, the grip 4 and the contact bars 2 move as a unit relative to the bar supports 3.

In the above-described warp stop motion mechanism, since the contact bars 2 are mounted on the side frame (not shown) of the loom through the contact bar support 3 which forms a separate body, the support mechanism for the contact bars is complicated and presents problems such as damage to the contact bars 2, unsatisfactory contact between a dropper and a contact bar 2 upon warp yarn breakage, and unsatisfactory electrical contact between the contact bar support 3 and the grip 4 due to incorrect positioning of the contact bars 2. Further, because of the use of the grip 4 as an attachment separate from the contact bar support 3, the number of components of a warp yarn breakage detecting circuit correspondingly increases, resulting in other problems including one that the stability of operation of the warp stop motion mechanism is lowered.

SUMMARY OF THE INVENTION

An object of the present invention is to provide a warp yarn detecting circuit reliable in operation and simple in construction, which is capable of eliminating the inconveniences found in the conventional warp stop motion mechanism.

As a means for achieving the foregoing object, the invention provides a warp stop motion mechanism, including droppers adapted to fall under their own weight upon warp yarn breakage, the contact bars for receiving said droppers, wherein the contact bars are held between a pair of upper and lower contact bar supports slidably installed on the side frame of the loom and a warp yarn breakage detecting circuit is disposed between the upper and lower contact bar supports and adapted to be closed by the natural fall of said droppers.

The warp yarn breakage detection performance of a loom is improved by fixedly arranging contact bars between a pair of side frames by a pair of upper and lower contact bar supports and providing a warp yarn breakage detecting circuit between the upper and lower bar supports.

DESCRIPTION OF THE PREFERRED EMBODIMENTS

Figure 1:
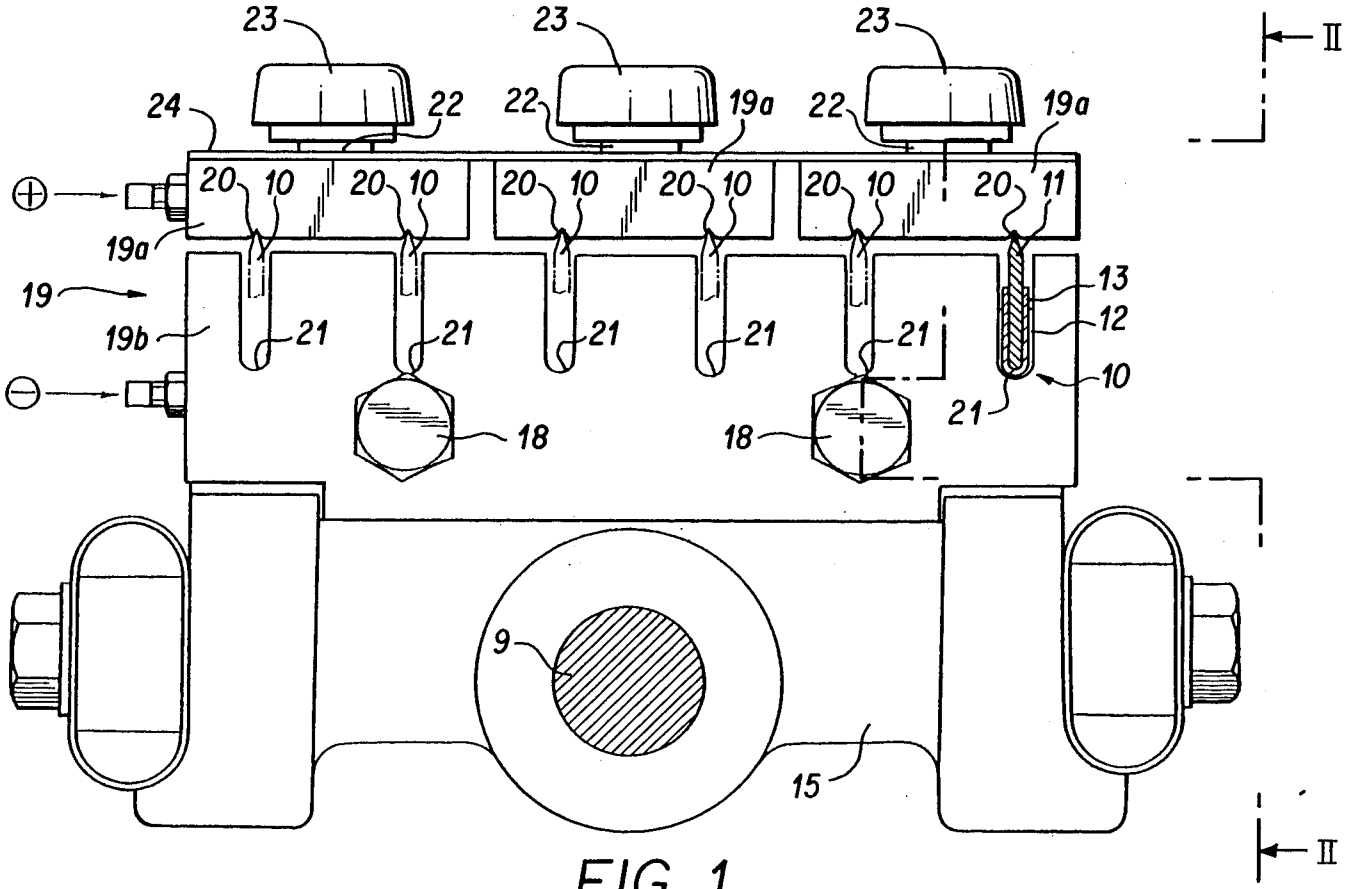
FIG. 1 is a side elevation view of the warp stop motion mechanism of the present invention.
Figure 2:
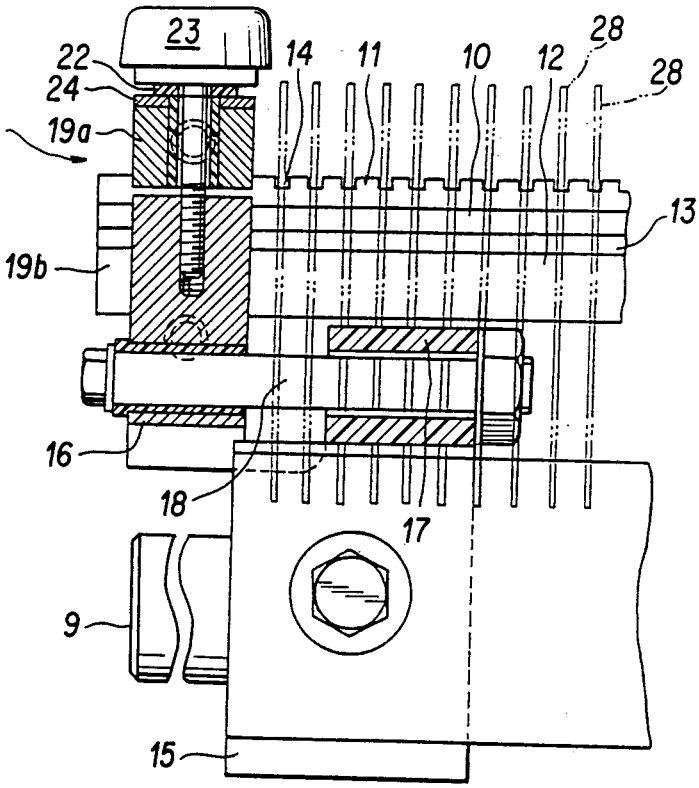
FIG. 2 is a view partly in section taken along the line II—II of FIG. 1.
Figure 5:
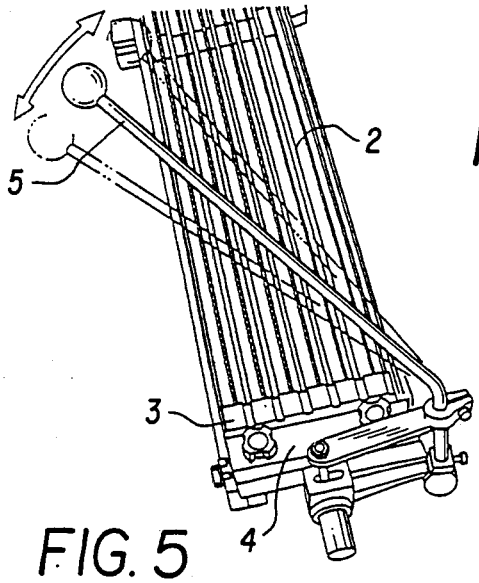
FIG. 5 PRIOR ART
FIG. 5 is a top perspective view of a conventional warp stop motion mechanism.
Figure 3:
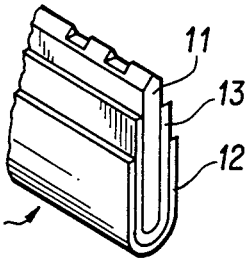
FIG. 3 is a perspective view of one end of a contact bar of the present invention.

FIG. 1 is a side elevational view of a warp stop motion mechanism according to the invention, and FIG. 2 is a taken along line II—II view thereof. As shown in these figures, contact bars 10 for receiving droppers which fall under their own weight upon warp yarn breakage constitute band-like dropper support members extending at right angles to the direction of travel of warp yarns and having, in the upper edges thereof, a plurality of dropper locking grooves 14 wherein anode plates 11 of electrically conductive material, for example, copper alloy, and cathode plates 12 of soft iron are integrally connected together with insulation plates 13 of insulation material, for example, polyamide resin therebetween. Associated with the contact bars 10, a contact bar support 19 of electrically conductive material, for example, aluminum alloy is provided at each side of the mechanism and mounted on the inner side of a side frame 15, only one of which is shown through insulation bushings 16 and 17 and a support 19 shaft 18 so the contact bar support is the direction of the axis of said support shaft 18, that laterally slidable in a direction substantially perpendicular to the direction of travel of warp yarns. The contact bar support 19 is thus movable to and fro along the direction of the axis of the support shaft 18 by manipulating a probing handle (shown by the reference numeral 5 in FIG. 5) attached to the side frame 15, making it easier to detect a dropper 28 falling under its own weight upon warp yarn breakage and fitting into a dropper locking groove 14 in a contact bar 10, that is, making the location of warp yarn breakage easier. The contact bar support 19 comprises an upper clamp member 19*a* formed with inverted V-shaped grooves 20 for receiving the anode plates 11 forming the contact bars 10, and a lower clamp member 19*b* having U-shaped grooves 21 for receiving and supporting the cathode plates 12; they are integrally connected together, with the contact bars 10 held therebetween, by set screws 23 having insulation bushings 22. In the illustrated embodiment, the upper clamp member 19*a* consists of three split type blocks each having two inverted V-shaped grooves 20. The upper and lower clamp members 19*a* and 19*b* thus comprise upper and lower contact bar supports. A connecting plate 24 of electrically conductive material, for example, copper, is disposed across the gaps between these split type blocks, the latter being in constant contact with the anode plates 11 of the contact bars 10, whereby the anode portion of the warp yarn breakage detecting circuit is formed.

Figure 6:
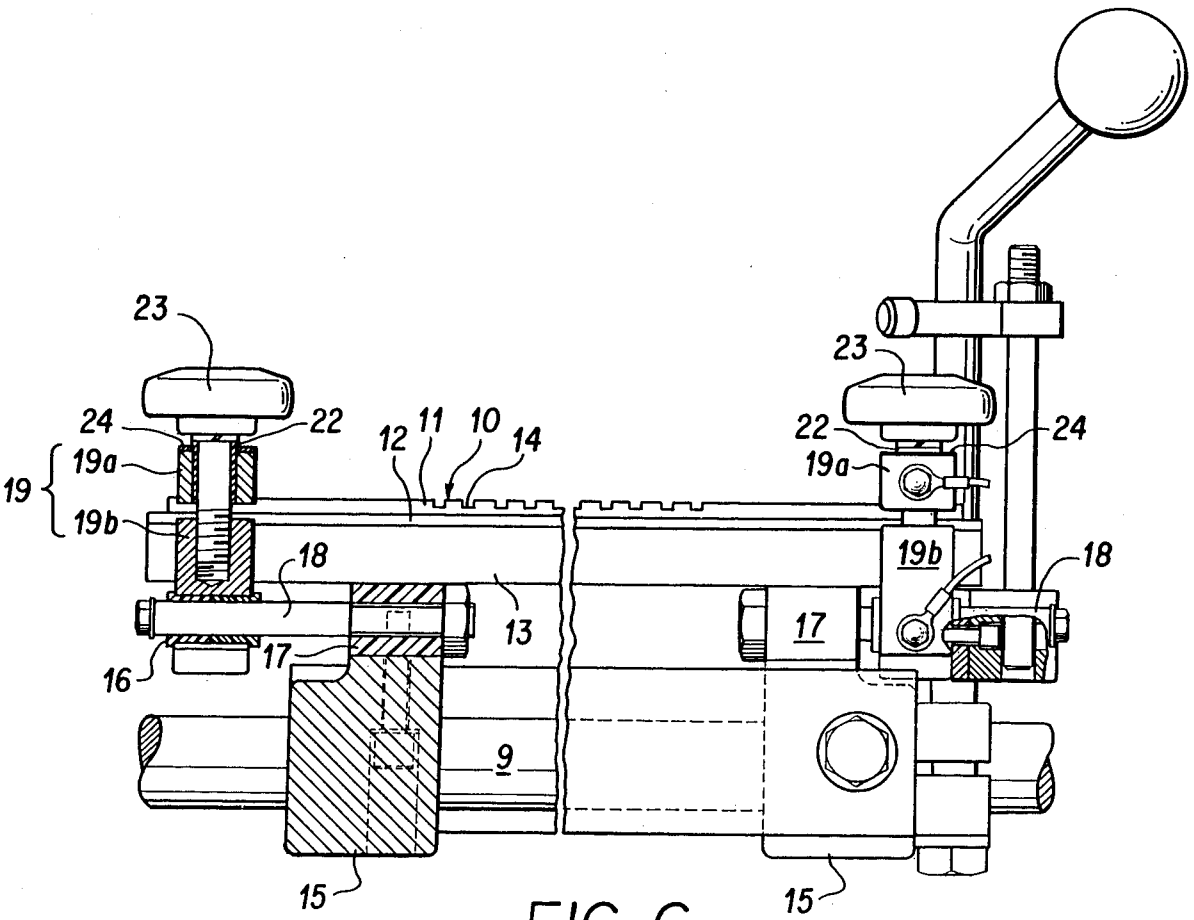
FIG. 6 is partial cross-sectional view of the warp stop motion mechanism of the present invention taken in the direction of arrows VI—VI shown in FIG. 1 illustrating an opposing side frame and an associated handle mechanism for moving a contact bar support and the contact bars relative to a mounting member.

As more clearly shown in FIG. 6, the support shafts 18 are secured to the member 17 which in turn is secured to the side frame 15. The contact bar support 19 is slidably mounted, by way of bushings 16, on the support shafts 18. The bushings 16 thus serve not only as an insulator, but also as a plane bearing. As further illustrated in FIG. 6, the right hand portion of shaft 18 is more clearly illustrated as extending through the member 17 and having screw threads. The pair of side frames 15 and the contact bar supports are slidably mounted to the side frames which are, in turn, adopted for mounting on a suitable stationary frame by way of shaft 9.

Figure 4:
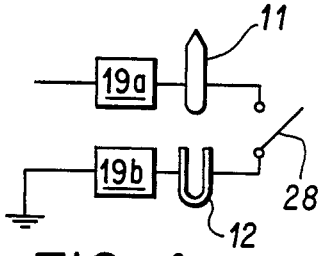
FIG. 4 is a schematic diagram of the warp yarn breakage detecting circuit of the present invention.

The device of the invention is constructed in the manner described above. Thus, when a warp yarn breaks and the associated dropper 28 falls under its own weight, the warp yarn breakage detecting circuit is closed through electrical conduction between the anode plate 11 and the cathode plate 12, that is, between the upper and lower clamp members 19*a* and 19*b* established by the dropper 28 which serves as a switch closing the yarn breakage detecting circuit as shown by FIG. 4. The closing of the warp yarn breakage detecting circuit causes the loom motor (not shown) to stop. In this state, the probing handle is manipulated to swing the contact bar support 19 and contact bars 10 to visually ascertain the position of the dropper 28 which fell under its own weight, thereby specifying the broken warp yarn.

The present inventive device employs a contact bar support mechanism which does not require a conventional grip, as described above. Thus, a warp yarn breakage detecting circuit can be formed which requires a reduced number of parts and which minimizes the danger of contact bars being damaged owing to improper tightening or unsatisfactory arrangement thereof. Further, in the present invention, the contact bars are mounted on the side frame by using a contact bar support alone without using a grip. Thus, the construction is simple, failure occurs less frequently, and electrical unsatisfactory contact between components of the warp yarn breakage detecting circuit can be effectively avoided.

While the invention has been particularly shown and described in reference to preferred embodiments thereof, it will be understood by those skilled in the art that changes in form and details may be made therein without departing from the spirit and scope of the invention.

What is claimed is:

1. A transversely movable warp stop motion mechanism for a loom of the type having a plurality of droppers with each dropper supported by a warp yarn and adapted to fall upon warp yarn breakage and contact bars about which said droppers are mounted said warp stop motion mechanism, comprising a pair of side frames each carried by a stationary shaft; a pair of upper and lower contact bar supports having bearing means and mounted for slidable movement relative to said side frames along support shafts carried by said side frames; and a warp yarn breakage detecting circuit, including said contact bars and said upper and lower contact bar supports wherein said upper and lower contact bar supports are adapted to hold said contact bars so that a dropper in said fallen position forms an electrical contact between said upper and lower contact bar supports so as to close said circuit.

* * * * *